US008873773B2

(12) United States Patent
Akino

(10) Patent No.: US 8,873,773 B2
(45) Date of Patent: Oct. 28, 2014

(54) CONDENSER MICROPHONE UNIT AND CONDENSER MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 185 days.

(21) Appl. No.: 13/455,331

(22) Filed: Apr. 25, 2012

(65) Prior Publication Data

US 2012/0269367 A1 Oct. 25, 2012

(30) Foreign Application Priority Data

Apr. 25, 2011 (JP) ..... 2011-096766

(51) Int. Cl.
*H04R 3/00* (2006.01)
*H04R 29/00* (2006.01)
*H04R 19/04* (2006.01)

(52) U.S. Cl.
CPC ..... *H04R 29/006* (2013.01); *H04R 19/04* (2013.01)
USPC ..... 381/113; 381/111; 381/174; 381/122

(58) Field of Classification Search
USPC ..... 381/111–114, 120, 174, 91, 122, 355, 381/356
See application file for complete search history.

(56) References Cited

U.S. PATENT DOCUMENTS

| | | | | |
|---|---|---|---|---|
| 4,491,697 | A * | 1/1985 | Tanaka et al. | 381/113 |
| 6,453,048 | B1 * | 9/2002 | Akino | 381/113 |
| 8,280,078 | B2 * | 10/2012 | Yoshino | 381/174 |
| 8,559,657 | B2 * | 10/2013 | Akino et al. | 381/111 |
| 2012/0114146 | A1 * | 5/2012 | Shimura | 381/174 |
| 2014/0064523 | A1 * | 3/2014 | Kropfitsch et al. | 381/174 |

FOREIGN PATENT DOCUMENTS

| | | |
|---|---|---|
| JP | 2006-295357 | 10/2006 |
| JP | 2011-10046 | 1/2011 |

* cited by examiner

*Primary Examiner* — Xu Mei
(74) *Attorney, Agent, or Firm* — Whitham Curtis Christofferson & Cook, PC

(57) ABSTRACT

A condenser microphone includes multiple condenser microphone units. Each unit includes an impedance converter. The condenser microphone units are connected in series such that outputs of the impedance converter in one of the condenser microphone units drive another of the condenser microphone units. A polarization voltage is accumulated to a DC voltage supplied from a DC voltage supply through a voltage adjuster to be applied to one of a diaphragm and a fixed electrode, and a voltage applied to the one of the diaphragm and the fixed electrode is adjusted by the voltage adjuster.

12 Claims, 2 Drawing Sheets

CONDENSER MICROPHONE UNIT AND CONDENSER MICROPHONE

TECHNICAL FIELD

The present invention relates to a condenser microphone unit and a condenser microphone that can reduce a variation in output signal level.

BACKGROUND ART

A condenser microphone unit is known that has a diaphragm vibrating in response to received sound waves that faces a fixed electrode across a spacer with a gap corresponding to the thickness of the spacer. A condenser microphone is also known that includes the condenser microphone unit. The diaphragm and the fixed electrode function as electrodes of a capacitor. The diaphragm vibrates in response to received sound waves to change the gap distance between the diaphragm and the fixed electrode. This varies the capacitance between the diaphragm and the fixed electrode. The variation in the capacitance responds to the sound waves and can be outputted as audio signals through electroacoustic conversion.

Condenser microphone units have a disadvantage of a large variation in sensitivity, i.e., output level. The variation in the sensitivity is caused by, for example, a variation in a voltage across the electrodes, i.e., between the diaphragm and the fixed electrode, a variation in the gap distance between the diaphragm and the fixed electrode, and distortion of the diaphragm and the fixed electrode. In particular, electret condenser microphone units, in which either the diaphragm or the fixed electrode is composed of an electret material to semi-permanently store charges, have a large variation in the charges. This causes a large variation in a voltage between electrodes composed of the diaphragm and the fixed electrode, resulting in a large variation in the sensitivity.

Meanwhile, condenser microphone units output significantly low levels of audio signals through electroacoustic conversion. Thus, to enhance the output level of a condenser microphone unit, the inventors applied for a patent on a condenser microphone including multiple condenser microphone units in which diaphragms are arranged on the same plane and the condenser microphone units are connected in series such that outputs from an impedance converter connected to one condenser microphone unit drive the ground terminal of another condenser microphone unit (see Japanese Patent Laid-Open Publication No. 2011-10046).

The condenser microphone described in Japanese Patent Laid-Open Publication No. 2011-10046 can accumulate outputs of the condenser microphone units connected in series to enhance the output level of the microphone. In addition, a first group composed of some of the condenser microphone units connected in series outputs hot signals of a balanced output while a second group composed of the other condenser microphone units connected in series outputs cold signals of the balanced output. This can further double the output level of the microphone. The outputs of individual microphone units can be accumulated as described above to provide a supersensitive condenser microphone and relatively reduce the equivalent sound pressure level of noise.

It is preferred that a difference in sensitivity should be eliminated among microphone units used in order to enhance the sensitivity in a condenser microphone described in, for example, Japanese Patent Laid-Open Publication No. 2011-10046. Even if the diaphragms of the microphone units are arranged on the same plane to align apparent directive axes, the microphone units with different sensitivities have directive axes misaligned with the directive axis of the microphone, and thereby the microphone cannot have an aligned directive axis. A difference in sensitivity should therefore be eliminated among the microphone units to equalize levels of audio signals outputted from the individual microphone units.

It is however significantly difficult to reduce the difference in sensitivity within, for example, ±1 dB among individual condenser microphone units of a conventional condenser microphone due to the factors causing such a difference as described above. A condenser microphone unit having adjustable sensitivity would be useful. A condenser microphone unit having sensitivity adjustable after being assembled in a microphone case is more useful. In particular, in a condenser microphone that accumulates output signals from multiple microphone units, adjustment of the sensitivities of individual microphone units is advantageous.

SUMMARY OF INVENTION

Technical Problem

It is an object of the present invention to provide a condenser microphone unit of which the sensitivity can be readily adjusted.

It is another object of the present invention to provide a condenser microphone including multiple condenser microphone units in which the sensitivity of individual microphone units assembled in a microphone case can be adjusted to avoid misalignment of the directive axis.

Solution to Problem

A condenser microphone unit according to an embodiment of the present invention includes a diaphragm and a fixed electrode facing each other with a predetermined gap therebetween, in which one of the diaphragm and the fixed electrode has an electret layer to generate a polarization voltage between the diaphragm and the fixed electrode, the polarization voltage is accumulated to a DC voltage supplied from a DC voltage supply through a voltage adjuster to be applied to the one of the diaphragm and the fixed electrode, and a voltage applied to the one of the diaphragm and the fixed electrode is adjusted by the voltage adjuster.

A condenser microphone according to an embodiment of the present invention includes multiple condenser microphone units each including a diaphragm and a fixed electrode facing each other with a predetermined gap and an impedance converter, in which the condenser microphone units being connected in series such that outputs of the impedance converter in one of the condenser microphone units drive another of the condenser microphone units, one of the diaphragm and the fixed electrode has an electret layer to generate a polarization voltage between the diaphragm and the fixed electrode, the polarization voltage is accumulated to a DC voltage supplied from a DC voltage supply through a voltage adjuster to be applied to the one of the diaphragm and the fixed electrode, and a voltage applied to the one of the diaphragm and the fixed electrode is adjusted by the voltage adjuster.

A condenser microphone including multiple condenser microphone units according to the embodiment of the present invention can adjust the voltage between the diaphragm and the fixed electrode by the voltage adjuster in each condenser microphone unit so as to equalize the sensitivities of all the condenser microphone units. This can provide a condenser microphone without a misaligned directive axis.

DESCRIPTION OF EMBODIMENTS

A condenser microphone unit and a condenser microphone according to an embodiment of the present invention will now be described with reference to the accompanying drawings.

[Embodiments]

Figure 1:
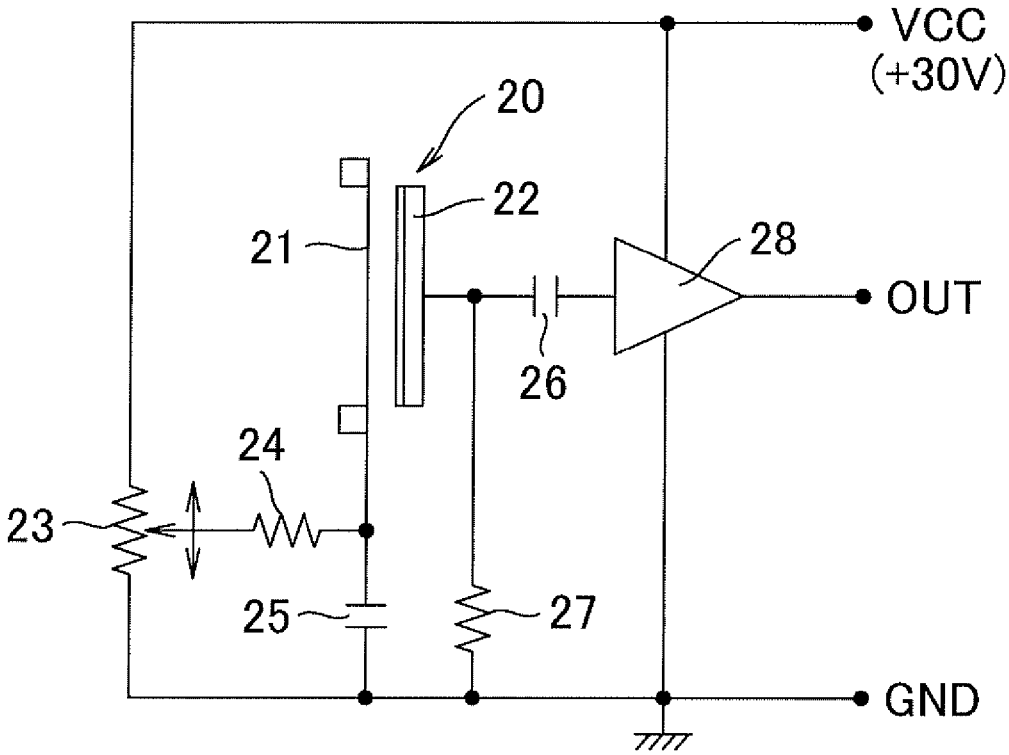
FIG. 1 is a circuit diagram illustrating a condenser microphone unit according to an embodiment of the present invention.

With reference to FIG. 1, a condenser microphone element 20 includes a diaphragm 21 and a fixed electrode 22 facing each other with a predetermined gap therebetween to define a capacitor. The diaphragm 21 and the fixed electrode 22 are accommodated in a proper microphone unit case not shown in the drawing. A spacer (not shown in the drawing) along the outer peripheries of the diaphragm 21 and the fixed electrode 22 defines the gap corresponding to the thickness of the spacer. One of the diaphragm 21 and the fixed electrode 22, for example, the fixed electrode 22 has an electret layer semipermanently storing charges on its surface. Vibration of the diaphragm 21 in response to received sound waves changes the gap distance between the diaphragm 21 and the fixed electrode 22 to change the capacitance between the diaphragm 21 and the fixed electrode 22. Sound is thereby outputted as audio signals through electroacoustic conversion.

Charges stored in the electret layer as described above generate a polarization voltage of, for example, about 100 V between the diaphragm 21 and the fixed electrode 22. The polarization voltage of the fixed electrode 22 relative to the diaphragm 21 is equal to about −100 V. A DC voltage is applied from a DC voltage supply VCC to the diaphragm 21 through a variable resistor 23 as a voltage adjuster. The variable resistor 23 is connected between the DC voltage supply VCC and the ground, and has a variable terminal connected through a resistor 24 to the diaphragm 21. In detail, the variable resistor 23 divides a voltage of the DC voltage supply VCC to apply the voltage to the diaphragm 21, and can continuously adjust this voltage. The voltage of the DC voltage supply VCC is set to, for example, about 30 V and can be divided into the range of 0 to 30 V through adjustment of the variable resistor 23 to apply the voltage to the diaphragm 21. This can adjust an equivalent polarization voltage applied between the diaphragm 21 and the fixed electrode 22 in the range of about 100 to 130 V.

In the embodiment shown in FIG. 1, signals are outputted from the fixed electrode 22 and inputted through a coupling capacitor 26 to an impedance converter 28, and the fixed electrode 22 is connected through a resistor 27 to the ground. The impedance converter 28 includes an active element such as an FET. The impedance converter 28 receives a driving voltage from the DC voltage supply VCC to have a predetermined portion connected to the ground, and thereby operates so as to send output signals of the microphone unit through an output terminal to the exterior.

Figure 2:
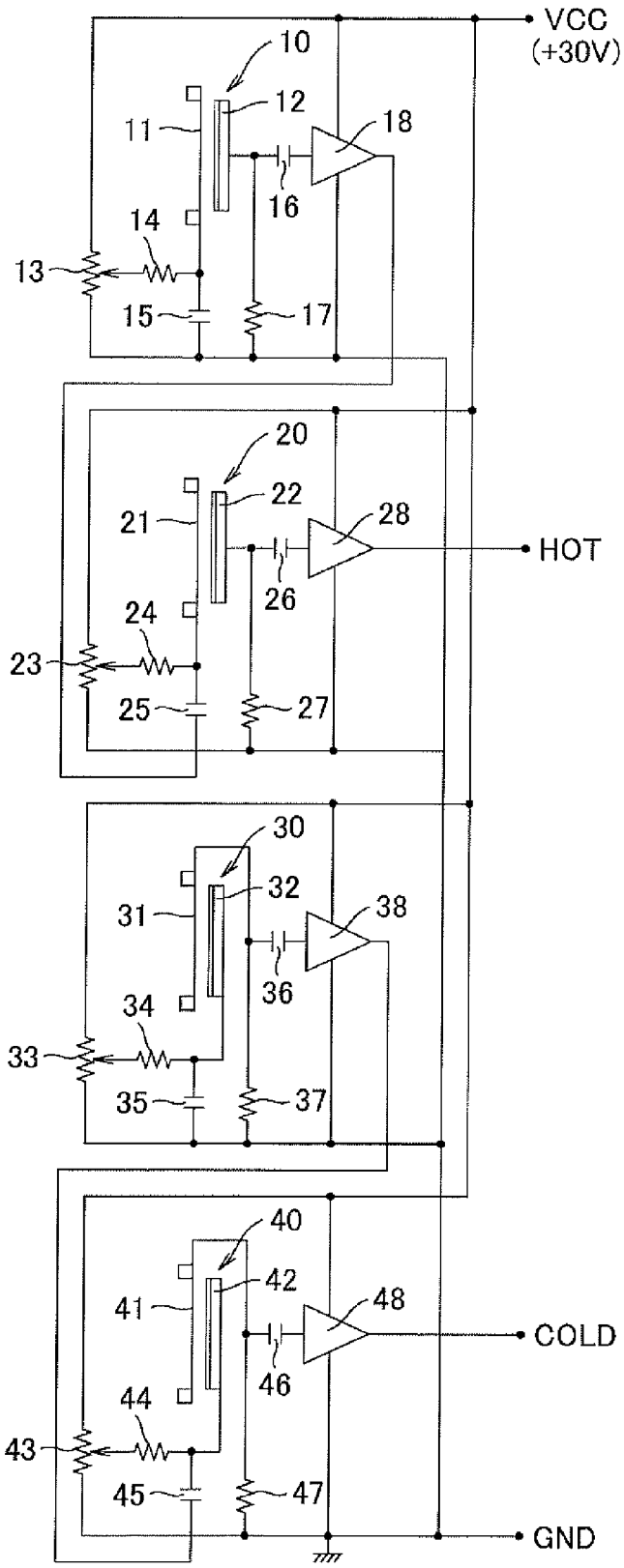
FIG. 2 is a circuit diagram illustrating a condenser microphone according to an embodiment of the present invention.

This condenser microphone unit is used alone while the diaphragm 21 is connected through a capacitor 25 to the ground. In contrast, the capacitor 25 in an example shown in FIG. 2 is floated from the ground. The reason is that the condenser microphone unit shown in FIG. 1 receives outputs of another microphone unit through the capacitor 25 in a condenser microphone including multiple microphone units connected in series as described below.

In the condenser microphone unit of the embodiment shown in FIG. 1, a voltage of the DC voltage supply VCC is divided by the variable resistor 23 as a voltage adjuster and is added to the polarization voltage generated between the diaphragm 21 and the fixed electrode 22. An equivalent polarization voltage applied between the diaphragm 21 and the fixed electrode 22 can be thereby adjusted in the range of about 100 to 130 V. The variable range of this equivalent polarization voltage can be alternatively expressed as 115 V±15 V. In other words, the sensitivity of the condenser microphone unit can be adjusted in the range of about ±1 dB, i.e., 2 dB. The variable resistor 23 can be implemented so as to be adjustable from the exterior of the microphone unit. The sensitivity is therefore adjusted readily.

With reference to FIG. 2, a condenser microphone including the multiple condenser microphone units shown in FIG. 1 will now be described in another embodiment. The condenser microphone in FIG. 2 includes four condenser microphone units. In FIG. 2, two upper microphone units belong to an upper microphone unit group, and two lower condenser microphone units to a lower microphone unit group. The microphone units include microphone elements 10, 20, 30, and 40. The microphone elements 10, 20, 30, and 40 include diaphragms 11, 21, 31, and 41 and fixed electrodes 12, 22, 32, and 42, respectively. The diaphragms 11, 21, 31, and 41 of the respective microphone units are arranged on the same plane.

The upper microphone unit group composed of two upper condenser microphone units in FIG. 2 will be described. The second microphone unit from the top in FIG. 2 has the same structure as the microphone unit in FIG. 1. The microphone unit at the top in FIG. 2 includes a microphone element 10 including a diaphragm 11 and a fixed electrode 12 facing each other with a predetermined gap, like the second microphone unit. One of the diaphragm 11 and the fixed electrode 12, for example, the fixed electrode 12 has an electret layer semipermanently storing charges on its surface. The vibration of the diaphragm 11 in response to received sound waves changes the gap distance between the diaphragm 11 and the fixed electrode 12 to change the capacitance between the diaphragm 11 and the fixed electrode 12. Sound is thereby outputted as audio signals through electroacoustic conversion.

Charges stored in the electret layer generate a polarization voltage between the diaphragm 11 and the fixed electrode 12. The polarization voltage of the fixed electrode 12 relative to the diaphragm 11 is equal to about −100 V. A variable resistor 13 is connected between the DC voltage supply VCC and the ground, and has a variable terminal connected through a resistor 14 to the diaphragm 11. The variable resistor 13 therefore divides the voltage of the DC voltage supply VCC to apply the voltage to the diaphragm 11, and can continuously adjust this voltage. As described above, the voltage of the DC voltage supply VCC is set to, for example, about 30 V. The adjustment of the variable resistor 13 can adjust the equivalent polarization voltage applied between the diaphragm 11 and the fixed electrode 12 in the range of about 100 to 130 V.

Signals are outputted from the fixed electrode 12 and inputted through a coupling capacitor 16 to an impedance converter 18, and the fixed electrode 12 is connected through a resistor 17 to the ground. The impedance converter 18 includes an active element such as an FET. The impedance converter 18 receives a driving voltage from the DC voltage supply VCC, has a predetermined portion connected to the ground, and thereby operates so as to send output signals of the microphone unit from an output terminal. The diaphragm 11 is connected through a capacitor 15 to the ground.

Since the second microphone unit from the top in FIG. 2 is the same as the microphone unit in FIG. 1, its components are denoted by the same reference numerals as those shown in FIG. 1. The output terminal of the impedance converter 18 in the microphone unit at the top in FIG. 2 is connected to one end of the capacitor 25 in the second microphone unit from the top. In other words, the top and second microphone units are connected in series such that the second microphone unit is driven by outputs of the impedance converter 18 of the top microphone unit. In the top and second microphone units connected in series, the second microphone unit outputs audio signals from the impedance converter 28.

The sensitivity of the top and second microphone units can be adjusted through adjustment of the variable resistors 13 and 23 in the top and second microphone units, respectively. If the diaphragms 11 and 21 are disposed on the same plane, the microphone units having different sensitivities cannot define a fixed directive axis of the microphone as described above. In contrast, in the embodiment shown in the drawings, adjustment of the variable resistors 13 and 23 can equalize the sensitivities of individual microphone units. This dissolves the problem of the unfixed directive axis of the microphone.

In the condenser microphone of the embodiment shown in FIG. 2, two upper microphone units output hot signals of a balanced output, and two lower microphone units, i.e., third and fourth microphone units output cold signals of the balanced output.

The third microphone unit includes a microphone element 30, a diaphragm 31, a fixed electrode 32, a variable resistor 33, a resistor 34, a capacitor 35, a coupling capacitor 36, a resistor 37, and an impedance converter 38 similarly to the top and second microphone units. A polarization voltage is generated between the diaphragm 31 and the fixed electrode 32, and a DC voltage changed by the variable resistor 33 is added to the polarization voltage, similar to the top and second microphone units.

The fourth microphone unit also includes a microphone element 40, a diaphragm 41, a fixed electrode 42, a variable resistor 43, a resistor 44, a capacitor 45, a coupling capacitor 46, a resistor 47, and an impedance converter 48, similar to the top and second microphone units. A polarization voltage is generated between the diaphragm 41 and the fixed electrode 42, and a DC voltage changed by the variable resistor 43 is added to the polarization voltage, similar to the top and second microphone units.

Two lower microphone units are different from two upper microphone units in that a voltage of the DC voltage supply VCC is divided by the variable resistors 33 and 43 to apply the voltage to the fixed electrodes 32 and 42 instead of the diaphragms 31 and 41, respectively. In addition, output signals of the lower microphone units are outputted from the diaphragms 31 and 41 instead of the fixed electrodes 32 and 42, respectively. In detail, the fixed electrode 32 is connected through the capacitor 35 to the ground, and the diaphragm 31 is connected through the coupling capacitor 36 to the impedance converter 38, in the third microphone unit. Outputs of the impedance converter 38 are inputted to the fixed electrode 42 of the fourth microphone unit through the capacitor 45. In other words, the third and fourth microphone units are connected in series such that the fourth microphone unit is driven by outputs of the impedance converter 38 of the third microphone unit. In the third and fourth microphone units connected in series, the fourth microphone unit outputs audio signals from the impedance converter 48.

In the embodiment shown in FIG. 2, electroacoustically converted signals are outputted from the fixed electrodes 12 and 22 in two upper microphone units connected in series and from the diaphragms 31 and 41 in two lower microphone units connected in series. In detail, output signals of two upper microphone units have phases opposite to those of output signals of two lower microphone units. The upper and lower microphone units output hot and cold signals of a balanced output, respectively.

In the condenser microphone of the embodiment shown in FIG. 2, two condenser microphone units are connected in series to generate a doubled output level. Signals of the doubled output level are outputted as hot and cold signals of the balanced output. This can further double the output level to generate a quadruple output level in total and thus provide a supersensitive condenser microphone.

In the condenser microphone units, the individual sensitivities can be controlled through adjustment of the respective variable resistors 13, 23, 33, and 43. If sensitivity is different among the condenser microphone units, the adjustment of the sensitivity of each microphone unit can eliminate the variation in the sensitivity. This can provide a condenser microphone without a misaligned or leaned directive axis.

What is claimed is:

1. A condenser microphone comprising:

multiple condenser microphone units each including:

a diaphragm;

a fixed electrode facing the diaphragm with a predetermined gap therebetween; and an impedance converter, wherein the condenser microphone units being connected in series such that outputs of the impedance converter in one of the condenser microphone units drive another of the condenser microphone units, one of the diaphragm and the fixed electrode has an electret layer to generate a polarization voltage between the diaphragm and the fixed electrode, the polarization voltage is accumulated to a DC voltage supplied from a DC voltage supply through a voltage adjuster to be applied to the one of the diaphragm and the fixed electrode, and a voltage applied to the one of the diaphragm and the fixed electrode is adjusted by the voltage adjuster.

2. The condenser microphone according to claim 1, wherein the diaphragms of the condenser microphone units are arranged in a same plane.

3. The condenser microphone according to claim 1, wherein a first condenser microphone unit group including some of the condenser microphone units outputs hot signals of a balanced output, and a second condenser microphone unit group including the other of the condenser microphone units outputs cold signals of the balanced output.

4. The condenser microphone according to claim 2, wherein a first condenser microphone unit group including some of the condenser microphone units outputs hot signals of a balanced output, and a second condenser microphone unit group including the other of the condenser microphone units outputs cold signals of the balanced output.

5. The condenser microphone according to claim 3, wherein one of the first and second condenser microphone unit groups outputs signals from the fixed electrode, and the other of the first and second condenser microphone unit groups outputs signals from the diaphragm.

6. The condenser microphone according to claim 4, wherein one of the first and second condenser microphone unit groups outputs signals from the fixed electrode, the other of the first and second condenser microphone unit groups outputs signals from the diaphragm, and output signals of the first microphone unit group have a phase opposite to a phase of output signals of the second microphone unit group.

7. The condenser microphone according to claim 1, wherein the voltage adjuster comprises a variable resistor that is externally adjustable.

8. The condenser microphone according to claim 2, wherein the voltage adjuster comprises a variable resistor that is externally adjustable.

9. The condenser microphone according to claim 3, wherein the voltage adjuster comprises a variable resistor that is externally adjustable.

10. The condenser microphone according to claim 4, wherein the voltage adjuster comprises a variable resistor that is externally adjustable.

11. The condenser microphone according to claim 5, wherein the voltage adjuster comprises a variable resistor that is externally adjustable.

12. The condenser microphone according to claim 6, wherein the voltage adjuster comprises a variable resistor that is externally adjustable.

* * * * *